US009132988B2

(12) United States Patent
Weissbrod

(10) Patent No.: US 9,132,988 B2
(45) Date of Patent: Sep. 15, 2015

(54) SYSTEM FOR MAINTAINING THE ORIENTATION OF A COIL

(71) Applicant: LINCOLN GLOBAL, INC., City of Industry, CA (US)

(72) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 249 days.

(21) Appl. No.: 13/794,925

(22) Filed: Mar. 12, 2013

(65) Prior Publication Data

US 2014/0117134 A1 May 1, 2014

Related U.S. Application Data

(60) Provisional application No. 61/719,327, filed on Oct. 26, 2012.

(51) Int. Cl.

| | |
|---|---|
| ***B65H 75/24*** | (2006.01) |
| ***B65H 49/08*** | (2006.01) |
| ***B65H 49/38*** | (2006.01) |
| ***B65D 85/672*** | (2006.01) |

(52) U.S. Cl.

CPC ..... *B65H 75/245* (2013.01); *B65D 85/672* (2013.01); *B65H 49/08* (2013.01); *B65H 49/38* (2013.01)

(58) Field of Classification Search

CPC ..... B65H 75/245

USPC ..... 242/571.3–571.5

See application file for complete search history.

(56) References Cited

U.S. PATENT DOCUMENTS

| | | | | |
|---|---|---|---|---|
| 17,379 | A * | 5/1857 | Knauer | 242/577.2 |
| 6,390,411 | B1 * | 5/2002 | Chal et al. | 242/613.2 |
| 2009/0152390 | A1 * | 6/2009 | Underbrink et al. | 242/432.6 |

FOREIGN PATENT DOCUMENTS

| | | |
|---|---|---|
| DE | 1168204 | 4/1964 |
| FR | 2572374 | 5/1986 |
| FR | 2581633 | 11/1986 |
| FR | 2904816 | 2/2008 |
| GB | 1096994 | * 1/1965 |
| GB | 1096994 | 12/1967 |
| WO | 2011106181 | 9/2011 |

OTHER PUBLICATIONS

International Search Report based on PCT/IB2013/002401 dated Apr. 15, 2014.

* cited by examiner

*Primary Examiner* — William E Dondero

(74) *Attorney, Agent, or Firm* — Hahn, Loeser & Parks LLP

(57) ABSTRACT

An assembly for maintaining the orientation of a coil having a longitudinal axis and an interior diameter defining a bore, the assembly comprising a core having a longitudinal axis; a plurality of members extending from the perimeter of the core and having inner and outer surfaces, where the plurality of members are biased radially outward; where the assembly has an expanded state where the members are radially unconstrained, the expanded state defining an expanded diameter greater than the interior diameter of the coil.

15 Claims, 4 Drawing Sheets

SYSTEM FOR MAINTAINING THE ORIENTATION OF A COIL

RELATED APPLICATION DATA

The present invention claims priority from U.S. provisional patent application No. 61/719,327 filed on Oct. 26, 2012. The disclosure of this application is incorporated by reference in its entirety herein.

TECHNICAL FIELD

The present invention generally relates to a system for maintaining the orientation of coiled wire. More particularly, the present invention relates to a system that includes an assembly insertable within the bore defined by a coil and expandable therein to contact an inner surface of the coil. Most particularly, the present invention relates to a system including an assembly having a core with plural resilient members extending outward from the core, where the resilient members are compressed to insert the assembly within the bore of a coil and released once the assembly is inserted causing the resilient members to expand against the interior surface of the coil.

BACKGROUND

Over the past decades, welding has become a dominant process in fabricating industrial and commercial products. Applications for welding are widespread and used throughout the world. Examples include the construction of ships, buildings, vehicles and pipe lines. Welding is also used in repairing or modifying existing products.

Large volumes of welding wire, or electrodes, may be stored and shipped in drums or boxes containing a central core designed to prevent shifting of the wire during transport or payoff of the wire. Even when such central cores are provided, there remains the possibility that the uppermost loops of the coiled wire may fall between the coiled wire and the core, resulting in wire tangles and the resultant downtime in remediating such tangles.

SUMMARY OF THE INVENTION

In one embodiment of the present disclosure, an assembly for maintaining the orientation of a coil having a longitudinal axis and an interior diameter comprises a core having a longitudinal axis. In addition, the assembly includes a core and a plurality of members extending from a perimeter of the core and having inner and outer surfaces, wherein a portion of each outer surface defines an assembly outer diameter. The assembly has an expanded state where the arcuate members are axially unconstrained defining a diameter greater than the interior diameter of the coil.

In another embodiment of the present disclosure, an assembly for maintaining the orientation of a coiled wire having a longitudinal axis and an interior diameter comprises a core having a longitudinal axis. In additional, the assembly comprises a plurality of arcuate members with an inner surface and an outer surface and including a biasing portion, a core portion, and an attachment portion. The inner surface of each attachment portion is attached to the inner surface of the core portion of the immediately adjacent arcuate member thereby forming an assembly core, where the biasing portions extend from the perimeter of the core and define an assembly outer diameter. The assembly has an expanded state where the arcuate members are axially unconstrained and a compressed state wherein the arcuate members are axially constrained.

In another embodiment of the present disclosure, a method for maintaining the orientation of a coiled wire comprises the steps of providing a container of coiled wire with the coiled wire having a longitudinal axis and an interior diameter. An assembly having an expanded state and a compressed state is provided, with the assembly including a core having a longitudinal axis and a plurality of resilient members extending from the perimeter of the core and having inner and outer surfaces, a portion of each outer surface defining an assembly outer diameter, wherein the outer diameter is greater than interior diameter of the wire when in the expanded state and less than the interior diameter of the wire when in the compressed state. The plurality of members are compressed by means for compressing the arcuate members to place the assembly into the compressed state, the compressed assembly is inserted coaxially within with the interior diameter of the coiled wire; and the means for compression are removed from the assembly to thereby bias a portion of the outer surface of each arcuate member against the interior diameter of the coiled wire.

DETAILED DESCRIPTION OF THE INVENTION

Figure 1:
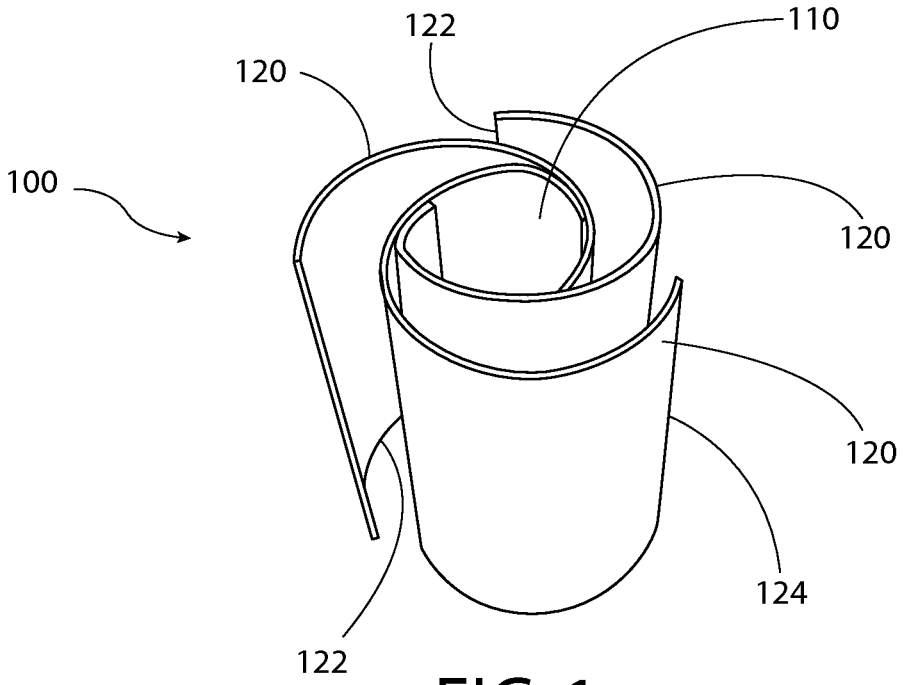
FIG. 1 is a perspective view of one embodiment of an assembly in accordance with the present disclosure.
Figure 2:
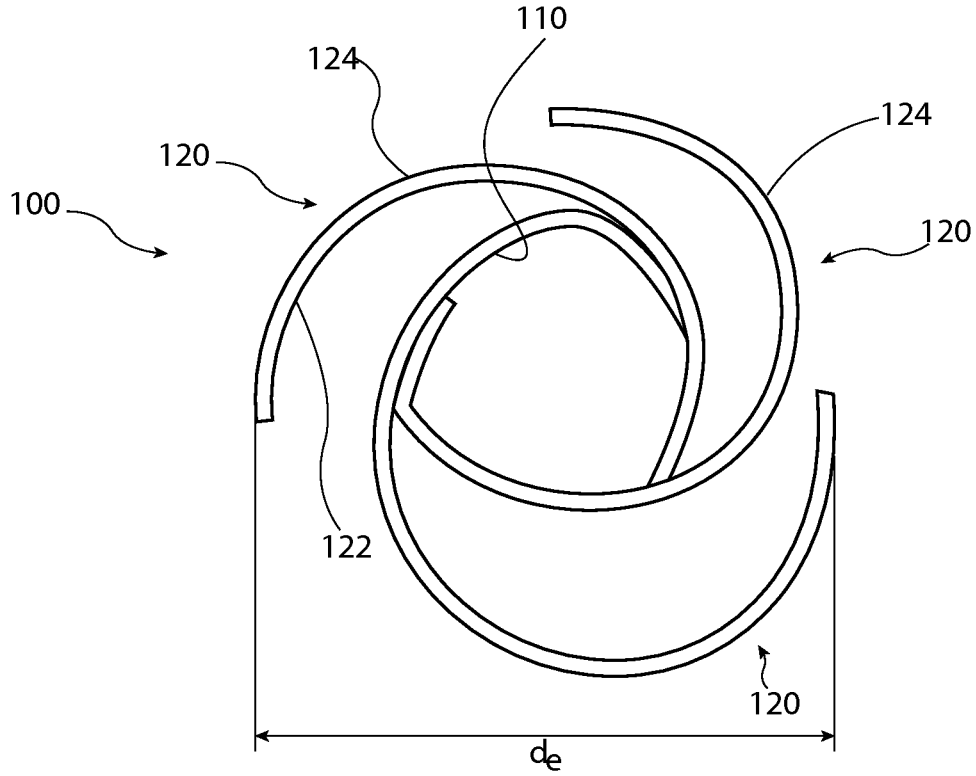
FIG. 2 is a top plan view of the assembly of FIG. 1.

Referring now to the drawings wherein the showings are for purposes of illustrating embodiments of the invention only and not for purposes of limiting the same, FIGS. 1 and 2 show a system for maintaining the orientation of a coil C. The coil C may be formed of any elongate and generally flexible material including, for example, fibers, tubing, or wire. The examples herein discuss use of a coil maintaining assembly applied to a wire coil. These examples, however, should not be considered limiting.

The system for maintaining a coil according to the invention includes an assembly, generally indicated at 100, that has a longitudinal axis and includes a central core 110. Core 110 may have any shape or cross section. In the example shown, assembly includes a cross-section that is a round sided polygon in shape and formed from a plurality of arcuate walls. As shown, the core 110 may have three sides like a triangle, yet each of the sides may be rounded or bowed rather than straight. In some instances where the core 110 has an odd number of sides, the shape of the core may be referred to as a Reuleaux polygon, which is a curve having a constant width. One or more members 120 are attached to core 110. Attachment may be made by any fastener 130 including mechanical fasteners, such as, a weld, bolt, rivet, staple, tape, or clip or chemical fastener, such as, an adhesive, resin, polymer layer, or other bonding agent. In the example shown, fastener 130 is an adhesive.

Members 120 may expand outward from core 110 to contact an inner surface of a coil to hold the coil in a desired orientation. Members 120 may be of any type or shape. The members 120 are compressed or arranged in a compressed configuration to facilitate insertion of assembly 100 within a bore defined by coil C. Once inserted, members 120 are placed in an expanded configuration that causes them to contact the interior surface of coil C. This expansion may occur by a mechanism that reconfigures members 120, a biasing member that drives members 120 outward from core 110, or an internal bias within the member 120 may cause to expand once the member is released, as described more completely below.

In the example shown in FIGS. 1 and 2, members 120 are arcuate and extend from a perimeter of core 110 and have an inner surface 122 and an outer surface 124, and in some instances, the members may be equally spaced about the perimeter of the core. The components of assembly 100 may be formed from cardboard, plastics, metals, or other materials known to one of ordinary skill in the art. In one instance, the assembly may be formed from fiber core material, which may be spirally wound or convolutedly wound.

The assembly 100 may be provided in an expanded state, that is, the arcuate members 120 are extended from the core 110. In the example shown, members 120 are resilient such that they are internally biased toward an expanded state where member 120 extend radially outward from core 110. In the expanded state shown, no radial constraint is applied to members 120 allowing them to achieve their maximum extension from core 110. In the expanded state, the assembly 100 has a diameter $d_e$, which is generally greater than the diameter $d_b$ of a bore defined by the interior surface of wire coil C. It should be understood that there may be some variance in the diameter of the coil along its longitudinal axis A due to the type of material being coiled or the manner in which it is coiled. The assembly diameter $d_e$ of the expanded assembly is selected to reinforce or maintain the orientation of coil C. For example, coil C may be loaded into a container in a desired configuration, but handling or shipping of the container may cause the coil C to shift or portions to move within the container. To maintain a desired orientation of coil C, assembly expands to contact the interior surface of coil C and may in some instances apply a radial outward force against coil C. Contact with coil C may be made any where along the longitudinal axis of coil C, and at any portion of member 120. It is not necessary for assembly 100 to achieve a fully expanded state to maintain the orientation of coil C. It will be appreciated that, in this manner, one assembly may be used with coils having bores of different diameter. The diameter $d_e$ of assembly in its expanded state may, likewise, be defined by any portion of members 120. For example, as shown, when an arcuate member 120 is used the outer extremity of member 120 may curly inward such that diameter $d_e$ is defined by a portion of each of the outer surface 124 of the arcuate members inward of the outer extremity.

In contrast to the expanded state, in the compressed state the assembly 100, and specifically the arcuate members 120, is radially constrained to have a second diameter which is less than the diameter of the coiled wire so that the assembly may be inserted coaxially into the interior of the coiled wire. Accordingly, the arcuate members 120 may be referred to as radially compressible. This compressed condition is referred to as the compressed state. The means for compressing the assembly may be any radial restraint including but not limited to an elastic band, zip tie, wire, belt, cuff, or strap encircling the diameter of the assembly, or a tape or film, such as, shrink wrap or the like. The means for compressing may also be a releasable mechanical device, such as cup or cap that fits over an end of the assembly, or a device having fingers or other members moveable between a position constraining the assembly 100 and a position not constraining the assembly.

Regardless of the material or materials chosen for manufacture of the assembly 100, the arcuate members 120 may be configured by combination of material and dimensions so that the arcuate members are resilient. Accordingly, the arcuate members 120 may be axially compressed toward the toward the core 110, but given the resilient configuration of the members, the members spring back or rebound toward the original position of the expanded state. In addition to the arcuate members 120 being formed of resilient material, it is also envisioned that the arcuate members may be attached to the core 110 at an intersection of two core walls and biased axially away from the longitudinal axis of the core, for example by a spring or other biasing device known to one of ordinary skill in the art. In such a configuration, the number of arcuate walls forming the core is equal to the number of arcuate members 120 extending from the core 110.

Figure 3:
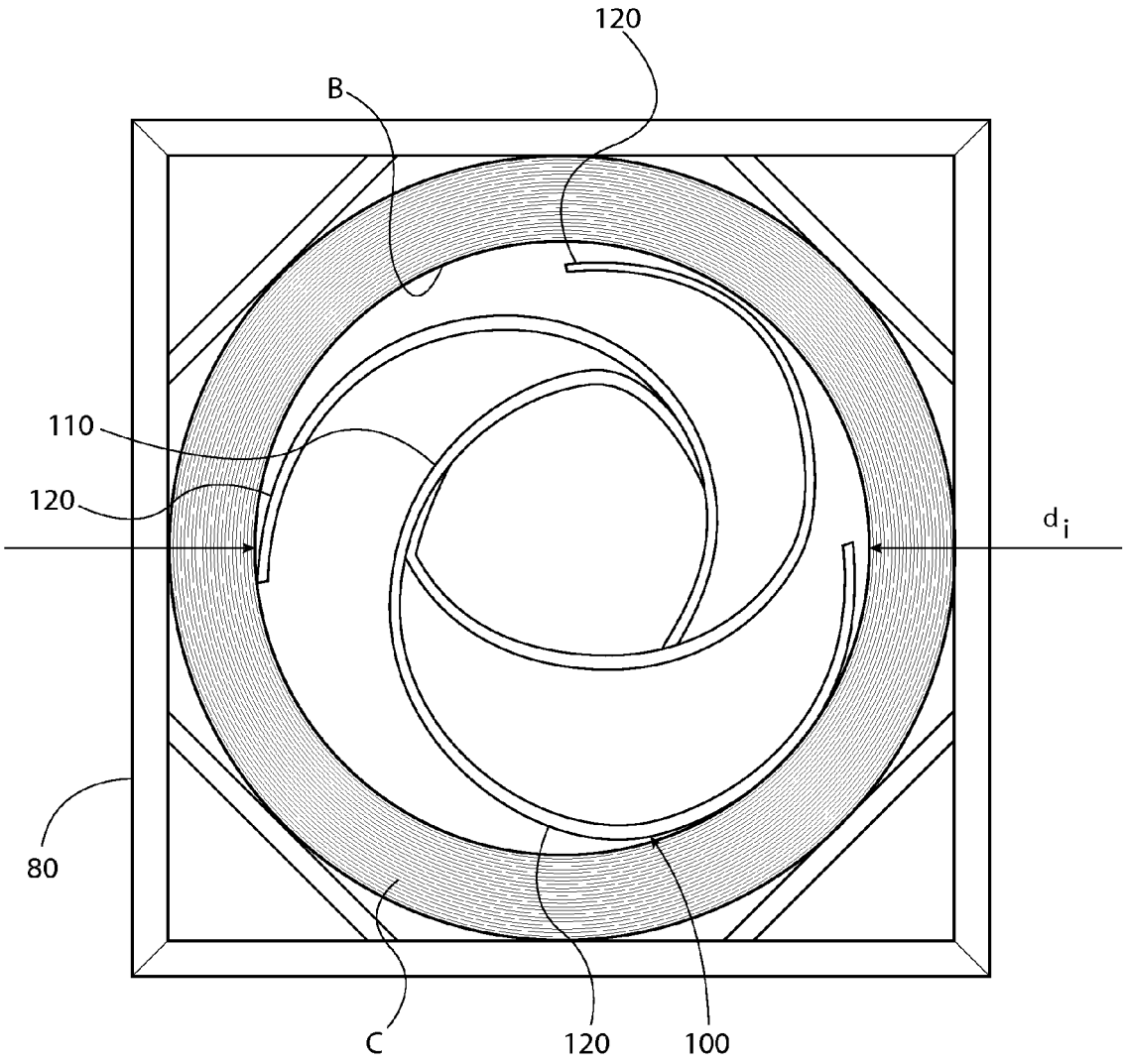
FIG. 3 is a top plan view of a the assembly shown in FIGS. 1 and 2 within a coil of wire.
Figure 4:
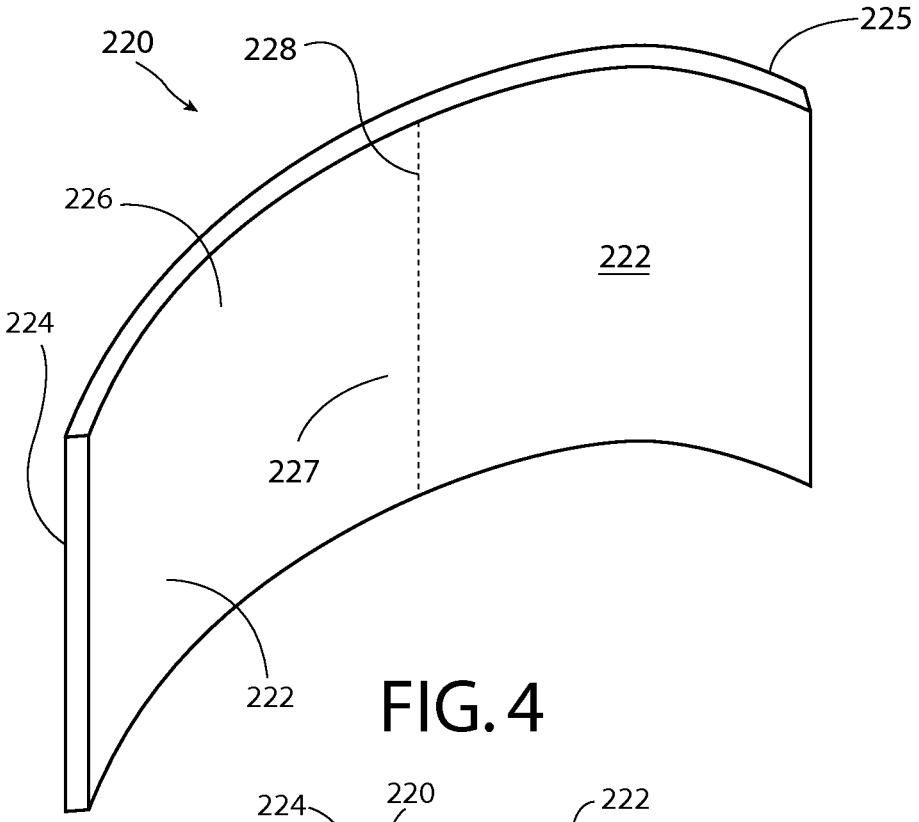
FIG. 4 is a perspective view of an arcuate member in accordance with the present disclosures.
Figure 5:
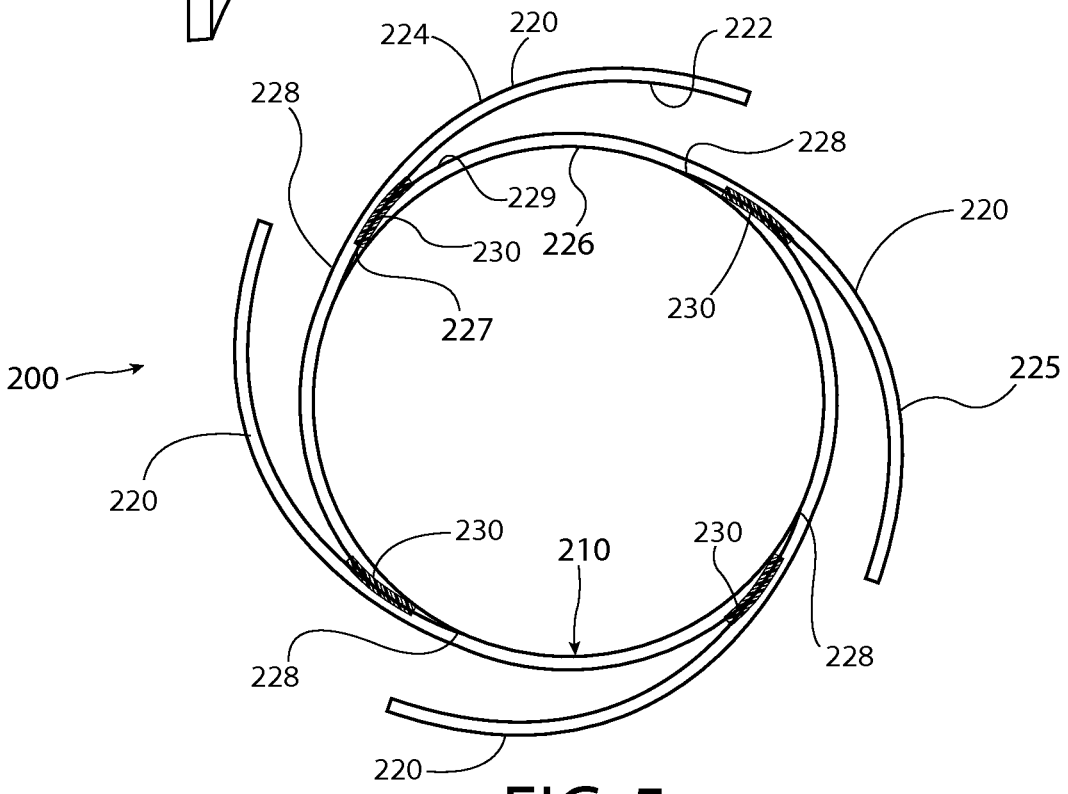
FIG. 5 is a top plan view of an embodiment of an assembly in accordance with the present disclosure.
Figure 6:
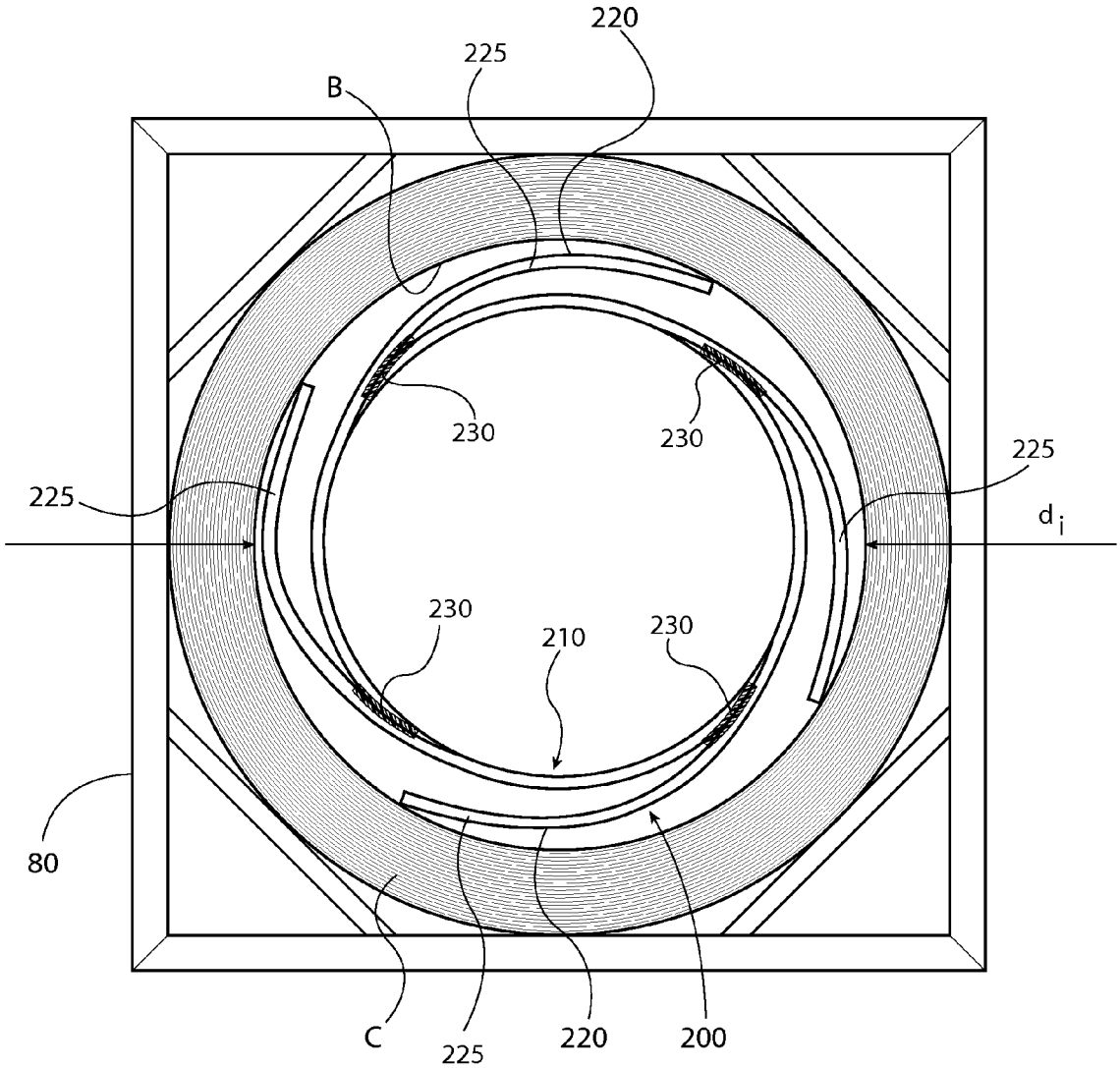
FIG. 6 is a top plan view showing the assembly of FIGS. 4 and 5 within a coil of wire.

In the embodiment shown in FIGS. 3-5, the assembly 200 includes a plurality of resilient arcuate members 220 having an inner surface 222 and an outer surface 224. Each arcuate member 220 includes a biasing portion 225, a core portion 226, and an attachment portion 227, which is separated from the core portion by a living hinge 228. In assembly, the outer surface 229 of each attachment portion 227 is attached to inner surface 222 of the core portion 226 of the immediately adjacent arcuate member 220. For purposes of this application, immediately adjacent means next to or following next in order. Attachment may be made by any fastener 230 including mechanical fasteners, such as, a weld, bolt, rivet, staple, tape, or clip or chemical fastener, such as, an adhesive, resin, polymer layer, or other bonding agent. In the example shown, fastener 230 is an adhesive. Once assembled, the core portions 226 form a core 210 from which the biasing member 225 extend.

With reference to FIG. 5, the depicted example includes four arcuate members 220 that are interconnected to each other to form a cylindrical core, generally indicated by the number 250. Core 250 is formed by core portions 226 of each member 220. Biasing portions 225 of each member 220 are connected to core portions 226 by a living hinge in the depicted example, but separate biasing portions may be attached to core 210 as discussed in the above embodiment. The biasing portions 225 are biased radially outward from core 210 by their resiliency. It will be appreciated that a biasing member may be used as an alternative to the resiliency of the material or in addition to the resiliency of the material as an option. For example, a biasing member, such as a spring, foam pad, inflatable bladder, or other flexible member, may be inserted between core 210 and biasing portion 225.

The assembly 200 has an expanded state when the arcuate members 220 are not radially constrained and a compressed state wherein the arcuate members are radially constrained. As best shown in FIG. 5, in the expanded state, biasing portions 225 flair outward from core 210 to form an expanded diameter $d_e$. Biasing portions 225 may be radially constrained or compressed in a more compact configuration creating a compressed diameter less than expanded diameter to allow assembly 200 to be axially inserted within the bore B formed by a wire coil C as discussed below.

In operation, a wire is laid in a coil C inside a container 80, which may be, for example, a box or a drum. Container 80 may also be referred to as a wire package or simply a package. Once the wire has been coiled in the package 80, the assembly 200 is compressed and then inserted into the bore B, or interior diameter, of the coil C. As will be appreciated, assembly 200 may be quite stiff and require significant force to compress biasing portions 225. While it is contemplated that this may be done manually, a compressing element may be provided to be used in place of manual compression or to facilitate manual compression. A compressing element may include any means for compressing biasing portions 225 sufficiently to fit with core. For example, the means for compressing the assembly may be any radial restraint including but not limited to an elastic band, zip tie, wire, belt, cuff, or strap encircling the diameter of the assembly, or a tape or film, such as, shrink wrap or the like. The means for compressing may also be a releasable mechanical device, such as cup or cap that fits over an end of the assembly, or a device having fingers or other members moveable between a position constraining the assembly 200 and a position not constraining the assembly.

Once the assembly 200 is inserted into the bore B of wire coil C, the means for compression are released or removed and the arcuate members 220 expand radially toward the expanded state. Given that the diameter $d_e$ of the assembly in the expanded state is greater than the bore diameter of the coil C, the biasing portions 225 engage the interior diameter $d_i$ of the wire and provide radial pressure against the wire. Accordingly, the possibility of the top loops of the coil C becoming entangled is diminished during shipping, storage, and wire payout, as there is a minimal gap, if any, between the biasing portions 225 and the interior diameter $d_i$ of coil C.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (e.g., that is functionally equivalent), even though not structurally equivalent to the disclosed structure which performs the function in the illustrated implementations of the invention. In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

The best mode for carrying out the invention has been described for purposes of illustrating the best mode known to the applicant at the time. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. An assembly for maintaining the orientation of a coil of welding wire, the assembly comprising:

a coil of welding wire, the welding wire having an internal bias created when forming the coil, the coil of welding wire defining a bore having a longitudinal axis and an interior diameter; and a plurality of members, each member having an inner surface and an outer surface, a core portion and an outer portion, where the core portion of each member is attached to the core portion of an adjacent member such that a portion of the inner surface of the core portion of one member engages a portion of the outer surface of the core portion of the adjacent member to form a core radially inward of the interior diameter and about the longitudinal axis, wherein the outer portion of each member extends radially outward from the core and wherein the outer portions of the plurality of members are biased radially outward toward an expanded state where the arcuate members are radially unconstrained, said expanded state defining an expanded diameter greater than the interior diameter of the coil.

2. The assembly of claim 1, wherein the plurality of members include three arcuate members, wherein said arcuate members are equally spaced about a perimeter of the core.

3. The assembly of claim 1, wherein said plurality of members are radially compressible to form a compressed assembly having a compressed diameter less than the expanded diameter.

4. The assembly of claim 3, wherein the compressed diameter is less than the interior diameter of the coil.

5. The assembly of claim 1, wherein a portion of each member exerts a radial force against the interior diameter of the coil when the assembly is inserted within the bore.

6. The assembly of claim 1, wherein the core portion of each member is an arcuate wall.

7. The assembly of claim 6, wherein each outer portion extends from an intersection of two arcuate walls.

8. An assembly for maintaining the orientation of a coil having a longitudinal axis and an interior diameter, the assembly comprising:

a plurality of arcuate members with an inner surface and an outer surface and including a biasing portion, a core portion, and an attachment portion, where the outer surface of each attachment portion engages and is attached to the inner surface of the core portion of the immediately adjacent arcuate member thereby forming an assembly core, where the biasing portions are biased outward from a perimeter of the assembly core toward an expanded state where the arcuate members are radially unconstrained and define an expanded diameter greater than the inner diameter of the coil.

9. The assembly of claim 8, wherein the arcuate members are flexible and biased outward by a resiliency within the arcuate members.

10. The assembly of claim 8, wherein the core portion and the biasing portion of the arcuate members are divided by a living hinge.

11. The assembly of claim 8, wherein said plurality of arcuate members includes four arcuate members.

12. The assembly of claim 8, wherein said assembly core defines a Reuleaux triangle.

13. The assembly of claim 8, wherein said assembly core is cylindrical.

14. A method for maintaining the orientation of a welding wire coil comprising the steps of:

providing a welding wire to form a coil within a container, the coil defining a bore having a longitudinal axis and an interior diameter;

providing an assembly having an expanded state and a compressed state, the assembly including a core having a longitudinal axis, wherein the core includes a plurality of resilient members, each of the plurality of resilient members of the core having an inner surface and an outer surface, wherein the outer surface of one of the plurality of resilient members within the core engages an inner surface of another of the plurality of resilient members within the core, the plurality of resilient members extending from a perimeter of the core, a portion of each outer surface on each of the plurality of resilient members defining an assembly outer diameter, wherein the outer diameter is greater than interior diameter of the coil when in the expanded state and less than the interior diameter of the coil when in the compressed state;

radially compressing the plurality of resilient members to place the assembly into the compressed state;

inserting the compressed assembly coaxially within with the interior diameter of the coil; and radially releasing the assembly to thereby bias a portion of the outer surface of each member against the interior of the coil.

15. The method of claim 14, where the step of radially compressing includes applying means for compressing to the assembly and the step of radially releasing includes removing the means for compressing from the assembly.

* * * * *